US005458507A

United States Patent [19]

Colescott et al.

[11] Patent Number: 5,458,507

[45] Date of Patent: Oct. 17, 1995

[54] FLUID RESISTANT ELECTRICAL CONNECTOR WITH BOOT-TYPE SEAL ASSEMBLY

[75] Inventors: Michael G. Colescott, Humble; Albert C. Demny, Houston; Wayne Kerr, Stafford, all of Tex.

[73] Assignee: EFT Interests, Ltd., Dallas, Tex.

[21] Appl. No.: 119,460

[22] Filed: Sep. 10, 1993

[51] Int. Cl.[6] ..... H01R 13/59

[52] U.S. Cl. ..... 439/589; 439/891

[58] Field of Search ..... 439/587, 588, 439/589, 598, 274, 275, 277, 279, 462

[56] References Cited

U.S. PATENT DOCUMENTS

| | | | |
|---|---|---|---|
| 2,355,166 | 8/1944 | Johnson | 174/77 |
| 2,740,098 | 3/1956 | Phillips | 439/589 |
| 3,576,517 | 4/1971 | Johnson et al. | 439/589 |
| 3,633,150 | 1/1972 | Swartz | 439/271 |
| 3,905,672 | 9/1975 | Anhalt et al. | 439/589 |
| 3,994,553 | 11/1976 | Kornick | 439/279 |
| 4,193,655 | 3/1980 | Herrmann, Jr. | 439/589 |
| 4,408,816 | 10/1983 | Knecht | 439/610 |
| 4,447,104 | 5/1984 | Haggard | 339/103 M |
| 4,693,534 | 9/1987 | Clark | 439/276 |
| 4,728,296 | 3/1988 | Stamm | 439/275 |
| 4,961,713 | 10/1990 | McCracken et al. | 439/587 |
| 5,123,860 | 6/1992 | Kamei et al. | 439/462 |

*Primary Examiner*—Neil Abrams

*Attorney, Agent, or Firm*—Pravel, Hewitt, Kimball & Krieger

[57] ABSTRACT

A fluid resistant electrical connector for a multiconductor electrical cable. The connector comprises a cylindrical shell assembly 20 with a cylindrical insert 34 therein. The cylindrical insert has a plurality of passageways 44 therethrough for receiving a contact receptacle 48 in each respective passageway. A boot seal 100 engages each conductor leading to a respective contact receptacle. Each boot seal has a first portion 102 and a second portion 104 with a coaxial bore therethrough. The coaxial bore has a plurality of internal circumferential ribs 108 therein. The first portion of the boot seal has a plurality of external circumferential ribs 114. A compression plate 122 has a plurality of bores 124 therethrough for receiving and engaging the boot seals. A compression gland 130, engagable with the rear portion of the shell assembly, is adapted to apply axial force to the compression plate which compresses the boot seals. A collet 138 engages the cable 74 and has an outer tapered portion 142 adapted to cooperatively engage a tapered end portion 136 of the compression gland 130. A collet retainer 144 threadably engages the rear portion of the shell assembly and engages the collet 138. The collet is compressed against the cable as the collet retainer is threadably tightened to the shell assembly.

14 Claims, 1 Drawing Sheet

FLUID RESISTANT ELECTRICAL CONNECTOR WITH BOOT-TYPE SEAL ASSEMBLY

BACKGROUND OF THE INVENTION

1. Field of the Invention

The present invention relates to fluid resistant electrical connectors and particularly to seal assemblies therefor.

2. Description of the Prior Art

Various approaches are known in the art for passing cable through a wellhead into the interior of a wellhead casing. The conductors of the cable are embedded in a dielectric material which is molded within and protected by a rigid metal shell of a connector assembly. One problem resides in the fact that the potting compounds holding the conductors in place are invariably attacked by the hot oil, hot fluids or gases used to facilitate the pumping of individual oil wells. These fluids attack externally by penetrating the connector assembly and internally by capillary action of the conductors within the downhole electrical cable. Both actions may result in an electrical failure by means of an electrical shorting action.

Additionally, the high pressure differentials cause minute cracks in the rigid bonding materials used, thereby leading to leaks in the system which, if not detected, may have the effect of causing blowouts in the well whenever a conductor is broken loose from the bonding material.

Thus, a basic problem with some prior art techniques resides in the maintenance of the integrity of the dielectric material which encases the conductors, and which passes from a low pressure environment to a high pressure environment.

There exists a need for an improved fluid resistant electrical connector assembly which will prevent any fluid leak from coming into contact with the conductors.

SUMMARY OF THE PRESENT INVENTION

The present invention is a fluid resistant electrical connector having a boot-type seal assembly which prevents any fluid leak from coming into contact with the conductors and a method of forming same.

The fluid resistant electrical connector comprises a substantially cylindrical shell assembly having a profiled axial bore therethrough. A substantially cylindrical insert having an external configuration is received in a front portion of the profiled axial bore. The cylindrical insert has a plurality of passageways therethrough for receiving a contact receptacle in each respective passageway.

A boot seal engages each conductor leading to a respective contact receptacle. Each boot seal has a first portion and a second portion with a coaxial bore therethrough. The coaxial bore has a plurality of internal circumferential ribs therein. The boot seal includes a first end face and an external circumferential shoulder between the first and second portions. The first portion of the boot seal has a plurality of external circumferential ribs.

A compression plate has a plurality of bores therethrough for receiving and engaging the boot seals. A compression gland, engagable with the rear portion of the shell assembly, is adapted to apply axial force to the compression plate which compresses the boot seals.

A collet engages the cable and has an outer tapered portion adapted to cooperatively engage a tapered end portion of the compression gland. A collet retainer threadably engages the rear portion of the shell assembly and engages the collet. The collet is compressed against the cable as the collet retainer is threadably tightened to the shell assembly. The collet and collet retainer transfer forces imposed on the cable to the shell assembly.

BRIEF DESCRIPTION OF THE DRAWINGS

In order to more fully understand the drawings referred to in the detailed description of the present invention, a brief description of each drawing is presented, in which.

DETAILED DESCRIPTION OF THE INVENTION

Figure 1:
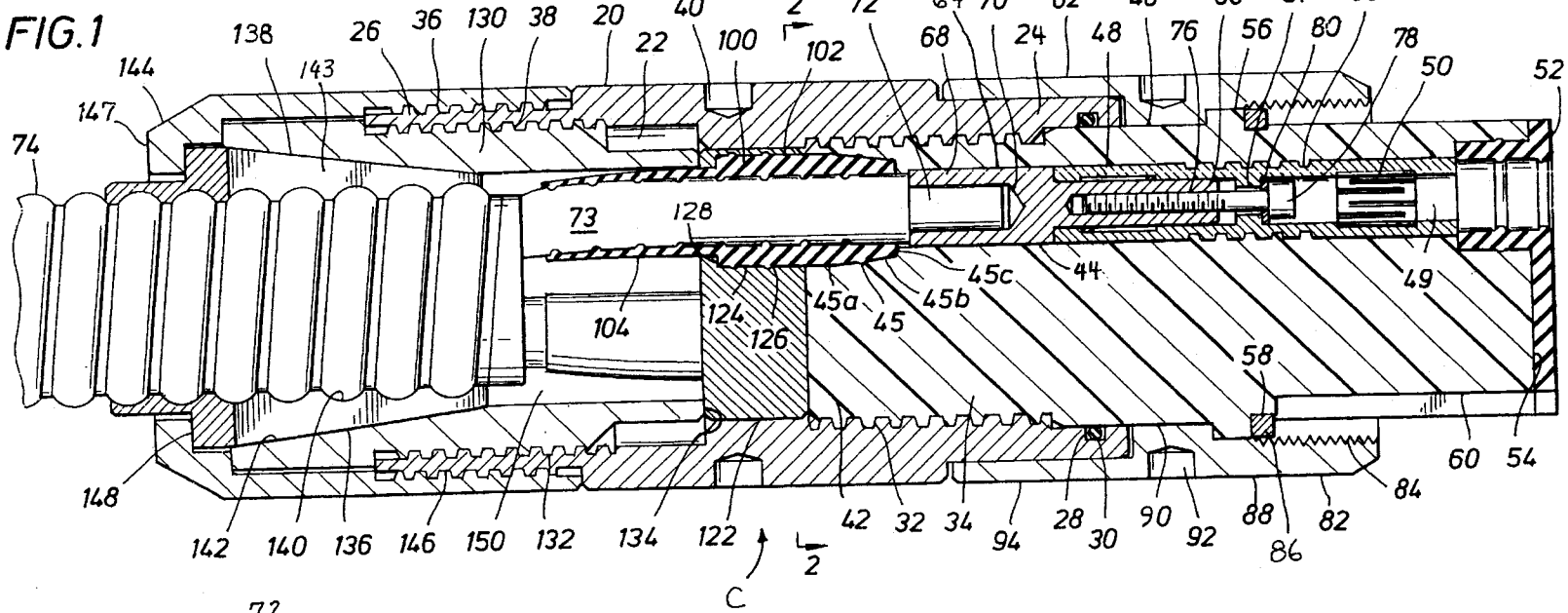
FIG. 1 is a cross-sectional view of the fluid resistant electrical connector with boot-type seal assembly of the present invention.

Referring now to the drawings in greater detail, the fluid resistant electrical connector with a boot-type seal assembly, generally designated by the letter C, comprises a substantially cylindrical shell assembly 20 having a profiled axial bore 22 therethrough. The shell assembly 20 includes a front portion 24 and a rear portion 26. The axial bore 22 at the front portion 24 of the shell assembly 20 includes a circumferential groove 28 for receiving a seal 30. Proximal the circumferential groove 28 is a threaded portion 32 for receiving a substantially cylindrical insert 34. The rear portion 26 of the shell assembly 20 includes an externally threaded portion 36 and an internally threaded portion 38. Preferably, the shell assembly 20 includes a pair of blind bores 40 spaced 180° from one another. The blind bores 40 are adapted to receive a spanner wrench (not shown) during assembly of the connector C.

The substantially cylindrical insert 34 has an external configuration which is received in the front portion 24 of the profiled axial bore 22 of the shell assembly 20. Preferably, the cylindrical insert 34 is made of a rigid, dielectric material such as polyetheretherkeytone (PEEK). The cylindrical insert 34 has a threaded end portion 42 which engages the threaded portion 32 of the shell assembly 20. The seal 30 sealingly engages a medial portion 46 of the cylindrical insert 34. The cylindrical insert 34 includes a plurality of passageways 44 therethrough for securely receiving a contact receptacle 48 in each respective passageway 44. Each passageway 44 includes a seal counterbore 45 having a constant diameter first section **45*a* and a tapering diameter second section 45*b* meeting a counterbore end face 45*c*. Each contact receptacle 48 includes a pair of contacts 50 in a longitudinal throughbore 49. The contact receptacle 48 includes an interior flange 51 of reduced diameter located substantially at the mid-section of the contact receptacle 48. In the preferred embodiment, the contact receptacle 48 is molded into the cylindrical insert 34 and is formed out of copper. The cylindrical insert 34 includes a plurality of internal ridges 35 in the passageways 44. The internal ridges 35 serve to maintain the molded contact receptacles 48 within the passageways 44**.

A contact pin 64, preferably made of copper, has a nose portion 66 and a body portion 68. Referring to FIG. 1, the body portion 68 includes a blind bore 70 for receiving a conductor 72 of the electrical cable 74. Preferably, the conductor 72 is connected to the contact pin 64 by crimping the contact pin 64. The nose portion 66 includes a threaded blind bore 76 for threadably receiving a screw 78. The nose portion 66 is inserted in a contact 50 in the contact receptacle 48. The screw 78, having a dielectric seal washer 80 thereon, extends through the interior flange 51 and threadably engages the threaded blind bore 76 of the nose portion 66. The screw 78 secures the contact pin 64 to the contact receptacle 48. A grommet seal 52 is attached to a forward end portion 54 of the cylindrical insert 34.

The medial portion 46 of the cylindrical insert 34 includes an outer flange 56 and an outer seal groove 58. The forward end portion 54 and grommet seal 52 include a polarizing means 60, as for example a longitudinal keyway to mate with a longitudinal key (not shown), to ensure that proper polarity is maintained when mating the connector C to a mating electrical connector.

A coupling nut 62 has a forward portion 82 with a means for threadably fastening 84 to a mating connector (not shown). The fastening means 84 is shown in FIG. 1 as interior threads adapted to engage with exterior threads of a mating connector. A face seal 86 is received in the outer seal groove 58 of the cylindrical insert 34 to sealingly engage the cylindrical insert 34 with the threaded end portion of the mating connector.

The coupling nut 62 has a central portion 88 with an interior shoulder 90 which is contained between the outer flange 56 of the cylindrical insert 34 and the front portion 24 of the shell assembly 20. The nut 62 is free to rotate relative to the connector shell assembly 20 when the coupling nut 62 is not tightened to a mating connector. Preferably, the coupling nut 62 includes a pair of blind bores 92 spaced 180° from one another and adapted to receive a spanner wrench (not shown) to tighten the nut 62 onto a mating connector. A rear portion 94 of the coupling nut 62 surrounds the front portion 24 of the shell assembly 20.

Figure 3:
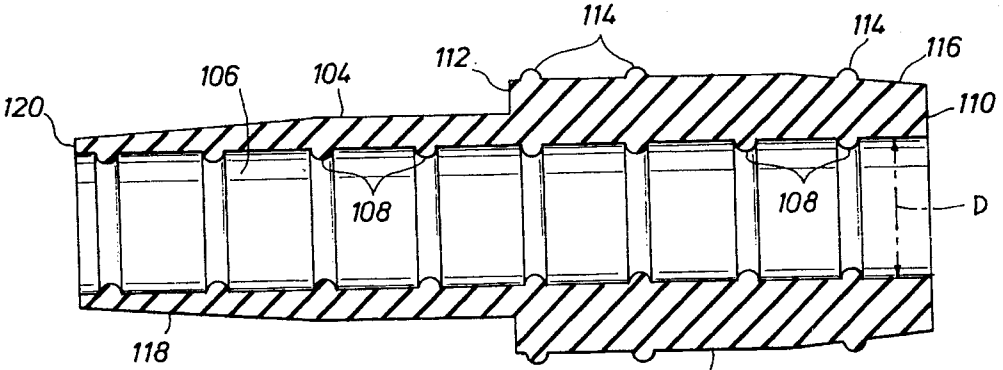
FIG. 3 is a cross-sectional view of the boot-type seal assembly.

Referring to FIG. 1, a boot seal 100 engages each conductor 72 leading to a respective contact receptacle 48. Referring to FIGS. 1 and 3, each boot seal 100 has a first portion 102 and a second portion 104 with a coaxial bore 106 therethrough. The coaxial bore 106 has a substantially uniform inside diameter D and a plurality of internal circumferential ribs 108 therein. The inside diameter D is dependent on the wire gauge of the electrical conductor 72, the thickness of the insulating jacket 73, and the manufacturer of the cable 74. The boot seals 100 are preferably flexible and able to withstand high temperatures. A desirable material out of which to make the boot seals is ethylene propylene diene methylene (EPDM), a rubber capable of withstanding temperatures of up to 350°–400° F.

In the preferred embodiment, the internal circumferential ribs 108 have an arcuate cross section having a radius of 0.03". The ribs 108 protrude from the coaxial bore 106 approximately 0.02" around the internal periphery of the coaxial bore 106.

Referring to FIG. 1, the boot seal 100 is slid entirely onto the insulating jacket 73 of the conductor 72 with the second portion 104 being first slid onto the insulating jacket 73. The internal circumferential ribs 108 grippingly engage the conductor insulating jacket 73.

The boot seal 100 includes a first end face 110 at the end of the first portion 102 and an external circumferential shoulder 112 between the first and second portions 102 and 104, respectively. The first portion 102 of the boot seal 100 has a plurality of external circumferential ribs 114 which are preferably similar in construction to the internal circumferential ribs 108 described above.

Referring to FIG. 3, the first portion 102 of the boot seal 100 has an inwardly tapering outer surface 116 at the first end face 110 and the second portion 104 has an inwardly tapering outer surface 118 at a second end face 120 of the boot seal 100 for reasons which will be explained below.

Figure 2:
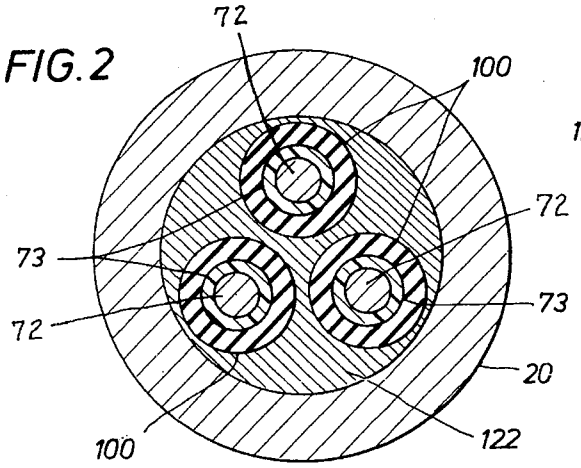
FIG. 2 is a view taken along line 2—2 of FIG. 1.

As shown in FIGS. 1 and 2, a compression plate 122 has a plurality of bores 124 therethrough for receiving and engaging the boot seals 100. The bores 124 of the compression plate 122 include a counterbore 126 having an end face 128. The bore 124 of the compression plate 122 is sized to receive the second portion 104 of the boot seal 100 therethrough. The counterbore 126 receives the first portion 102 therein with the external circumferential shoulder 112 between the first and second portions 102 and 104 contacting the end face 128 of the counterbore 126. The seal counterbore 45 of the cylindrical insert 34 also receives the first portion 102 of the boot seal 100 therein with the first end face 110 of boot seal 100 contacting the counterbore end face **45*c***.

A compression gland 130 is threadably engagable with the rear portion 26 of the shell assembly 20. The compression gland 130 includes an externally threaded portion 132 which threadably engages the internally threaded portion 38 of the rear portion 26 of the shell assembly 20. The compression gland 130 has an end face 134 adapted to apply axial force to the compression plate 122 which compresses the boot seals 100. The compression gland 130 further includes a tapered end portion 136.

Still referring to FIG. 1, a collet 138 has an opening 140 therethrough sufficient to receive the cable 74. The collet 138 has a tapered end portion 142 adapted to cooperatively engage the tapered end portion 136 of the compression gland 130. Preferably, the tapered end portion 142 of the collet 138 is radially cut into a plurality of segments 143 to permit the tapered end portion 142 to securely grip the cable 74 as explained below. A collet retainer 144 has an internally threaded portion 146 which threadably engages the externally threaded portion 36 of the rear portion 26 of the shell assembly 20. The collet retainer 144 has an end flange 147 which abuts a collet bearing face 148. The collet 138 is compressed against the cable 74 as the collet retainer 144 is threadably tightened to the shell assembly 20. The collet 138 and collet retainer 144 transfer forces imposed on the cable 74 to the shell assembly 20 of the connector C.

A body 150 is formed of a special potted dielectric material surrounding the conductors 72 between the compression plate 122 and the collet 138. Preferably, the plurality of conductors, typically three in number, are positioned substantially parallel to each other and are affixed in position with the special potted dielectric material. The body 150 of special potted dielectric material withstands high pressure and insulates the conductors 72 from crossing currents. The special dielectric potting material completely fills all internal gaps in the connector assembly C.

Assembly of the Present Invention

Briefly, the assembly of the present invention will be explained with reference to FIG. 1. The cylindrical insert 34 is molded with the contact receptacles 48 therein. The seal 30 is placed in the circumferential groove 28 of the cylindrical shell assembly 20. The coupling nut 62 is installed onto the front portion 24 of the shell assembly 20. The cylindrical insert 34 is then inserted through the coupling nut 62 and threaded into the shell assembly 20.

The cable 74 is prepared by removing an end portion of the outer protective coating so that the conductors 72 extend therefrom. A short length of the insulating jacket 73 is removed from the end of each conductor 72. The collet retainer 144, the collet 138, and the compression gland 130 are slid onto the cable 74. The conductors 72 are inserted through the bores 124 of the compression plate 122.

A contact pin 64 is crimped to each conductor 72. A boot seal 100 is installed onto each conductor 72. The boot seal 100 is slid entirely onto the insulating jacket 73 of the conductor 72 with the second portion 104 being first slid onto the insulating jacket 73. The internal circumferential ribs 108 grippingly engage the conductor insulating jacket 73. The compression plate 122 is slid onto the second portion 104 of the boot seals 100 until the end face 128 of the counterbore 126 contacts the external circumferential shoulder 112 of the boot seal 100. At this time the counterbore 126 partially receives the first portion 102 of the boot seals 100.

The cable is inserted into the rear portion 26 of the shell assembly 20. The contact pins 64 are guided through the cylindrical insert passageways 44 to the contact receptacles 48. A screw 78 with a dielectric seal washer 80 is inserted in the longitudinal throughbore 49 of each contact receptacle 48. The screws 78 threadably engage the threaded blind bore 76 of the nose portion 66 of the contact pin 64 to secure the contact pin 64 to the contact receptacle 48. The grommet seal 52 is inserted to the forward end portion 54 of the cylindrical insert 34.

The compression gland 130 is threadably engaged with the rear portion 26 of the shell assembly 20. The end face 134 of the compression gland 130 axially forces the compression plate 122 towards the cylindrical insert 34. The first portion 102 of the boot seals 100 are entirely received and compressed within the counterbore 126 of the compression plate 122 and the seal counterbore 45 of the cylindrical insert 34 when the compression gland 130 is fully threaded into the shell assembly 20. The compression gland 130 is fully threaded when the compression plate 122 is abutting the cylindrical insert 34. The procedure of mechanically compressing the first portion 102 of the boot seals 100 effectively preloads the boot seals 100 to a minimal threshold level prior to the connector C and the boot seals 100 being subjected to the pressure within the well bore environment.

The body 150 surrounding the conductors 72 between the compression plate 122 and the collet 138 is formed by injecting the special potted dielectric material from the rear of the connector C. Preferably, the plurality of conductors 72, typically three in number, are positioned substantially parallel to each other and are affixed in position with the special potted dielectric material.

The collet retainer 144 and the collet 138 are slid towards the compression gland 130. The tapered end portion 143 of the collet 138 is received in the tapered end portion 136 of the compression gland 130. The collet retainer 144 threadably engages the rear portion 26 of the cylindrical shell assembly 20. The collet 138 is compressed against the cable 74 as the collet retainer 144 is threadably tightened to the shell assembly 20.

The present invention receives significant resistance to fluid coming into contact with the conductors 72 from the plurality of internal and external circumferential ribs 108 and 114, respectively, of the boot seals 100. The plurality of ribs form a series of stacked seals which act in concert to prevent the intrusion of fluid from the rear of the connector.

The foregoing disclosure and description of the invention is illustrative and explanatory thereof, and various changes in the size, shape, and materials, as well as in the details of illustrative construction and assembly, may be made without departing from the spirit of the invention.

We claim:

1. A fluid resistant electrical connector for a shielded multiconductor electrical cable, the fluid resistant electrical connector comprising:

a substantially cylindrical shell assembly having a profiled axial bore therethrough, said shell assembly having a front portion and a rear portion;

a substantially cylindrical insert having an external configuration received in said front portion of said profiled axial bore, said cylindrical insert having a plurality of passageways therethrough;

a plurality of contact receptacles, one said contact receptacle received in each respective said passageway;

a boot seal engaging each conductor leading to a respective said contact receptacle, each said boot seal having a bore therethrough with a plurality of internal circumferential ribs therein;

means for compressing said plurality of boot seals, said compressing means having (i) a compression plate to engage said boot seals, and (ii) a compression gland engageable with said rear portion of said shell assembly to apply axial force to said compression plate; and means for transferring forces imposed on the cable to said shell assembly, said transferring means having (i) a collet engaging the cable and adapted to engage said compression gland, and (ii) a collet retainer engaging said rear portion of said shell assembly and said collet so that said collet retainer compresses said collet against the cable.

2. The connector of claim 1, wherein said boot seal comprises:

a first portion having a plurality of internal circumferential ribs; and a second portion connected to said first portion, wherein said first and second portions have a coaxial bore therethrough.

3. The connector of claim 2, wherein said second portion of said boot seal includes a plurality of internal circumferential ribs.

4. The connector of claim 2, wherein said first portion of said boot seal includes a plurality of external circumferential ribs.

5. The connector of claim 2, wherein said first portion of said boot seal has an outer diameter greater than the outer diameter of said second portion of said boot seal.

6. The connector of claim 5, wherein said boot seal includes a first end face and an external circumferential shoulder between said first and second portions.

7. A fluid resistant electrical connector for a multiconductor electrical cable, the fluid resistant electrical connector comprising:

a substantially cylindrical shell assembly having a profiled axial bore therethrough, said shell assembly having a front portion and a rear portion;

a substantially cylindrical insert having an external configuration received in said front portion of said profiled axial bore, said cylindrical insert having a plurality of passageways therethrough;

a plurality of contact receptacles, one said contact receptacle received in each respective said passageway;

a boot seal engaging each conductor leading to a respective said contact receptacle, each said boot seal having a first portion and a second portion with a coaxial bore therethrough, said coaxial bore having a plurality of internal circumferential ribs therein and said first portion of said boot seal having a plurality of external circumferential ribs;

means for compressing said plurality of boot seals, said compressing means having (i) a compression plate to engage said boot seals, and (ii) a compression gland engageable with said rear portion of said shell assembly to apply axial force to said compression plate; and means for transferring forces imposed on the cable to said shell assembly, said transferring means having (i) a collet engaging the cable and adapted to engage said compression gland, and (ii) a collet retainer engaging said rear portion of said shell assembly and said collet so that said collet retainer compresses said collet against the cable.

8. The connector of claim 7, wherein said first portion of said boot seal has an outer diameter greater than the outer diameter of said second portion of said boot seal.

9. The connector of claim 7, wherein said boot seal includes a first end face and an external circumferential shoulder between said first and second portions.

10. The connector of claim 7, wherein said circumferential ribs have an arcuate cross section.

11. The connector of claim 7, wherein each said passageway of said cylindrical insert includes a coaxial boot receiving counterbore and each said bore in said compression plate includes a coaxial boot receiving counterbore, wherein said first portion of each said boot seal is fully received in said coaxial boot receiving counterbores of said cylindrical insert and said compression plate.

12. The connector of claim 11, wherein said boot seal includes a first end face and an external circumferential shoulder between said first and second portions and said first end face and said external circumferential shoulder confine said first portion of said boot seal in said coaxial boot receiving counterbores.

13. A fluid resistant electrical connector for a multiconductor electrical cable, the fluid resistant electrical connector comprising:

a substantially cylindrical shell assembly having a profiled axial bore therethrough, said shell assembly having a front portion and a rear portion;

a substantially cylindrical insert having an external configuration received in said front portion of said profiled axial bore, said cylindrical insert having a plurality of passageways therethrough;

a plurality of contact receptacles, one said contact receptacle received in each respective said passageway;

a boot seal engaging each conductor leading to a respective said contact receptacle, each said boot seal having a first portion and a second portion with a coaxial bore therethrough, said coaxial bore having a plurality of internal circumferential ribs therein, said boot seal including a first end face and an external circumferential shoulder between said first and second portions, said first portion of said boot seal having a plurality of external circumferential ribs;

means for compressing said plurality of boot seals, said compressing means having (i) a compression plate to engage said boot seals, and (ii) a compression gland engageable with said rear portion of said shell assembly to apply axial force to said compression plate; and means for transferring forces imposed on the cable to said shell assembly, said transferring means having (i) a collet engaging the cable and adapted to engage said compression gland, and (ii) a collet retainer engaging said rear portion of said shell assembly and said collet so that said collet retainer compresses said collet against the cable.

14. The connector of claim 13, wherein each said passageway of said cylindrical insert includes a coaxial boot receiving counterbore and each said bore in said compression plate includes a coaxial boot receiving counterbore, wherein said first portion of each said boot seal is fully received in said coaxial boot receiving counterbores of said cylindrical insert and said compression plate and said first end face and said external circumferential shoulder confine said first portion of said boot seal in said coaxial boot receiving counterbores.

* * * * *